US006059315A

United States Patent [19]

Selph

[11] Patent Number: 6,059,315

[45] Date of Patent: May 9, 2000

[54] SPARK CREATING RECREATION OR SPORTS DEVICE

[76] Inventor: Shawn Eric Selph, 37311 47 St. East, #37, Palmdale, Calif. 93552

[21] Appl. No.: 08/878,983

[22] Filed: Jun. 19, 1997

Related U.S. Application Data

[63] Continuation-in-part of application No. 08/711,107, Sep. 9, 1996, abandoned.

[51] Int. Cl.[7] ..... A63C 17/026

[52] U.S. Cl. ..... 280/809; 280/87.042

[58] Field of Search ..... 280/87.042, 87.041, 280/11.2, 816, 11.27, 11.28, 809; 446/22, 23

[56] References Cited

U.S. PATENT DOCUMENTS 3,990,713 11/1976 Hokanson ..... 280/87.042

4,394,037 7/1983 Kuntz ..... 280/816

4,834,407 5/1989 Salvo ..... 280/87.042

*Primary Examiner*—Richard M. Camby

*Attorney, Agent, or Firm*—Dennis Beech

[57] ABSTRACT

The spark creating recreation or sports device is a wheeled device having flint pads attached to surfaces which may be brought into contact with an environmental surface such as a street, sidewalk, railing, etc. The protective devices worn when using such recreation or sports wheeled devices may also have flint pads attached to surfaces which may be rubbed against an environmental surface. Examples of protective devices include knee, elbow and hand pads and helmets. Also spark creating devices may be pad mounted flint pads which flint pads create sparks when scraped against a surface and the pad mounts can be attached to a skateboard surface or to the wheel mounts. A further spark creating device consists of a flint pad having integral to it a fastener which may be used for attachment to a skateboard.

1 Claim, 4 Drawing Sheets

SPARK CREATING RECREATION OR SPORTS DEVICE

This is a continuation-in-part of application Ser. No. 08/711,107 filed Sep 9, 1996, application Ser. No. 08/711, 167 is abandoned.

BACKGROUND OF THE INVENTION

1. Field of the Invention

This invention relates to wheeled devices used for recreation and sports such as skateboards, roller blades, roller skates, etc. The new device includes a simple means to create sparks when the device is scraped against an environmental surface such as a street, sidewalk, railing or other similar friction surface.

2. Description of Related Art

There are currently in use devices for attachment to wheeled sports and recreational products which create sparks when the wheels turn during use of the product. Examples include the attachment of a flint adjacent to a rotating element of the wheel or axle of a wheeled device such as a roller skate. When the roller skate is used by a person causing the wheels to rotate, the flint is struck to cause sparks to be emitted. This application is similar to the use of a rotating wheel in a lighter to rub against a flint to create a spark to light the lighter.

In addition there are complicated mechanisms for holding pyrotechnic materials which may be mounted under skateboards. An example of such a structural device is represented in U.S. Pat. No. 4,834,407. In this case part of the housing, i.e., the fins, is consumed in operating the device. Such devices are complicated to manufacture and use in the simple skateboard application.

The present invention provides a recreation or sports device which creates sparks when various surfaces of the device are rubbed against an environmental surface such as a sidewalk. A flint pad is attached to the device surface which is intended to be used to create sparks. When the recreation device is used such that it is in motion the proper device surface with flint pad is caused to rub against an environmental surface causing friction which creates the spark.

SUMMARY OF THE INVENTION

A primary objective of the present invention is to provide a recreation or sports device which creates sparks when a device surface is rubbed against an environmental surface.

In accordance with the description presented herein, other objectives of this invention will become apparent when the description and drawings are reviewed.

DESCRIPTION OF THE PREFERRED EMBODIMENT

The spark creating recreation/sport device consist of flint pads attached to device surfaces which are intended to be brought into contact with environmental surfaces when the device is in use. If a skateboard has flint pads attached to the front and rear bottom surface, when the board is tilted on the front or rear wheels the flint pad may be brought in contact with the ground thus creating sparks. When flint is referred to herein the meaning is for any material used for producing sparks such as alloys of various commonly known elements and metals with such properties.

Figure 1:
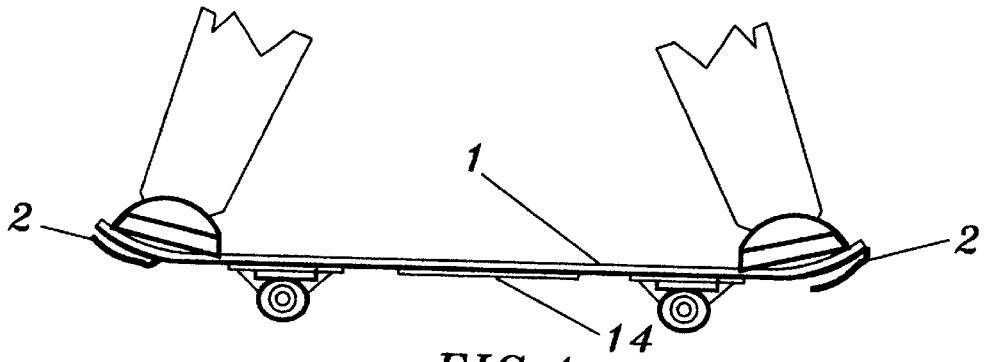
FIG. 1 illustrates a side elevation view of a skateboard with flint pads.
Figure 2:
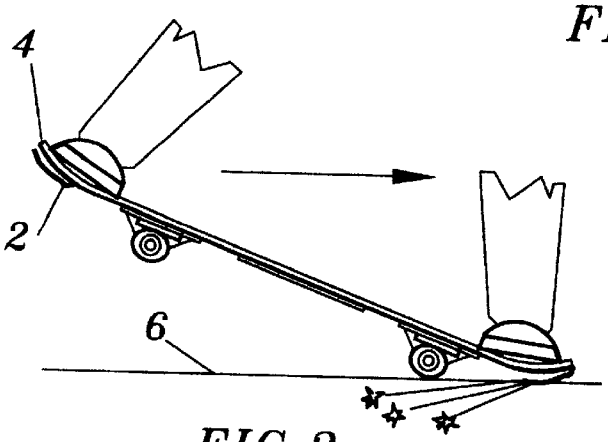
FIG. 2 illustrates a side view of a skateboard with front flint pad engaging the ground.
Figure 3:
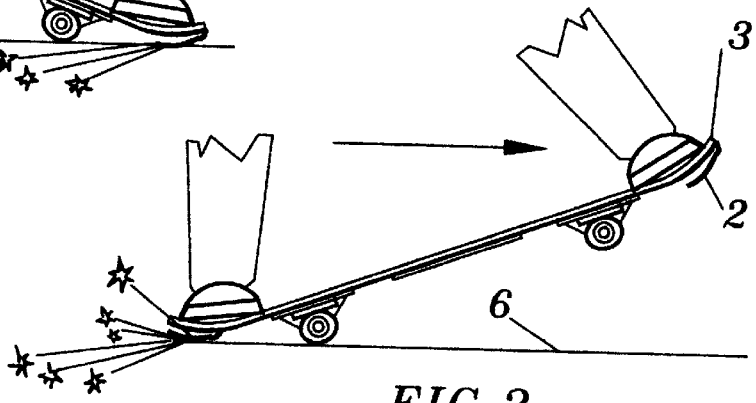
FIG. 3 illustrates side view of a skateboard with rear flint pad engaging the ground.
Figure 4:
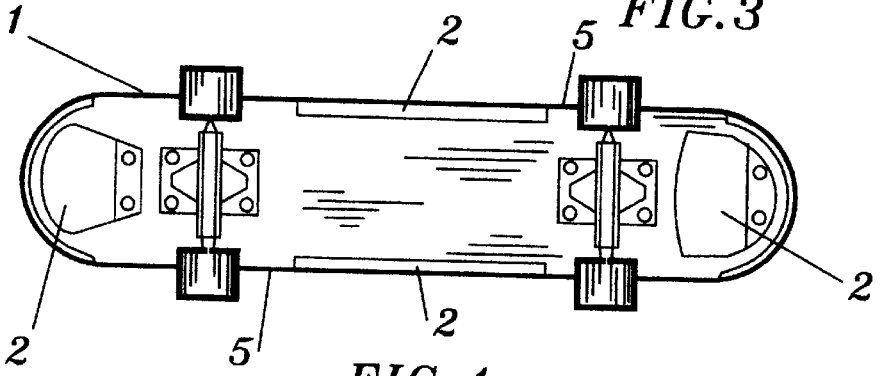
FIG. 4 illustrates a bottom plan view of a skateboard with flint pads.
Figure 5:
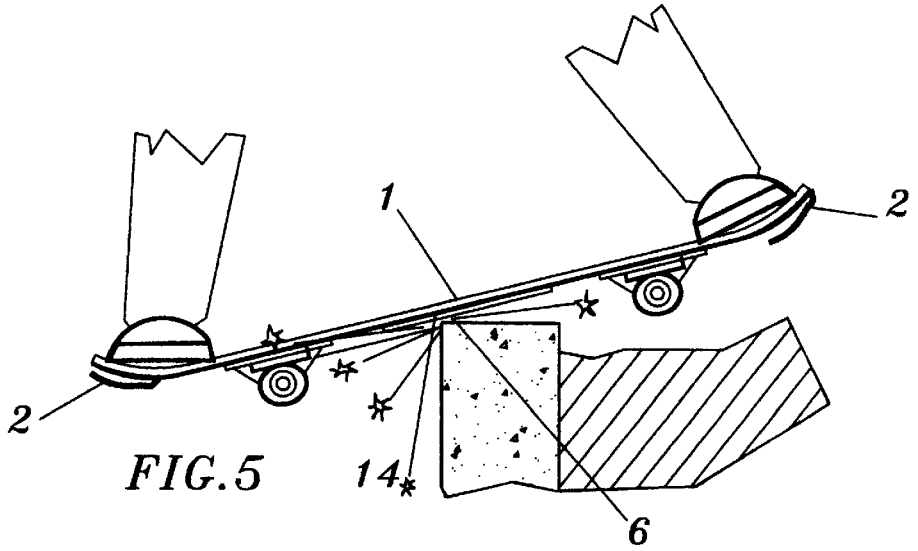
FIG. 5 illustrates a side view of a skateboard with flint pads engaging a railing.

Referring to FIGS. 1 through 5, a skateboard (1) has flint pads (2) attached to an environmental contact surface (13) such as the front edge (3), rear edge (4) and sides (5). The flint pad (2) may be a simple rectangular shape or may be formed in a strip which may be molded around the curvature of an edge such as the front edge (3). As illustrated in FIGS. 2, 3 and 5 when the flint pad (2) is rubbed against an environmental surface (6) such as a sidewalk or railing, the friction causes sparks to be emitted. In FIG. 5 the flint pad (2) is attached to the bottom center (14).

Figure 6:
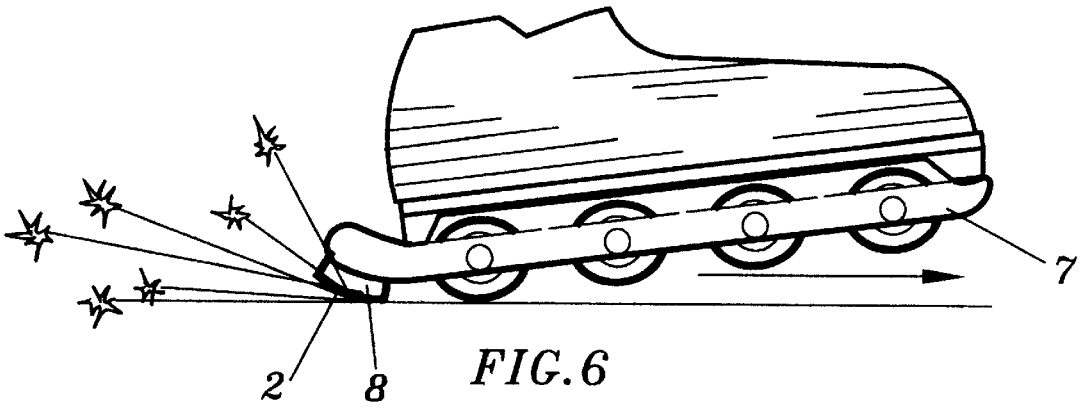
FIG. 6 illustrates a side elevation view of a roller blade with flint pad on the brake pad.
Figure 7:
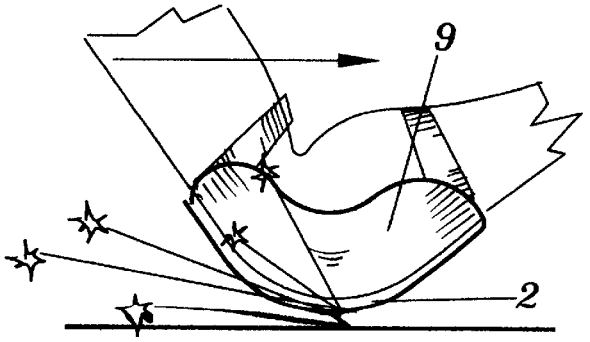
FIG. 7 illustrates a side view of an arm protector pad with flint pad rubbing an environmental surface.
Figure 8:
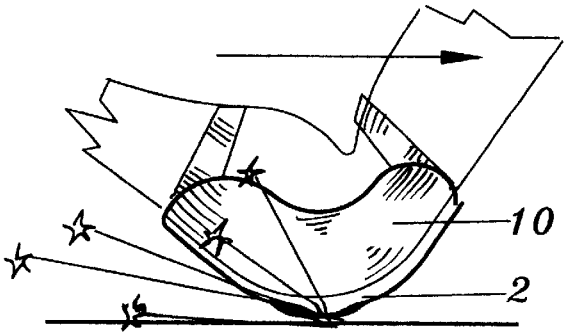
FIG. 8 illustrates a side view of a knee protector pad with flint pad rubbing an environmental surface.
Figure 9:
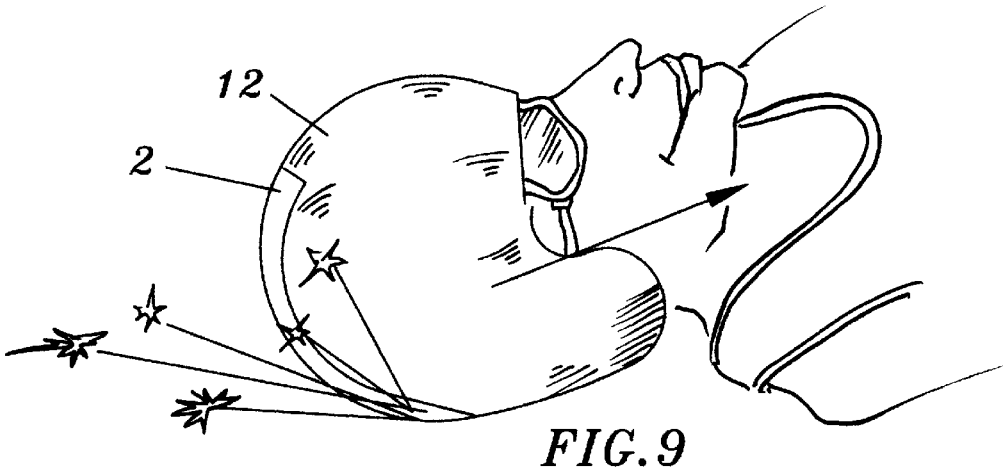
FIG. 9 illustrates a perspective view of a helmet with flint pad rubbing an environmental surface.
Figure 10:
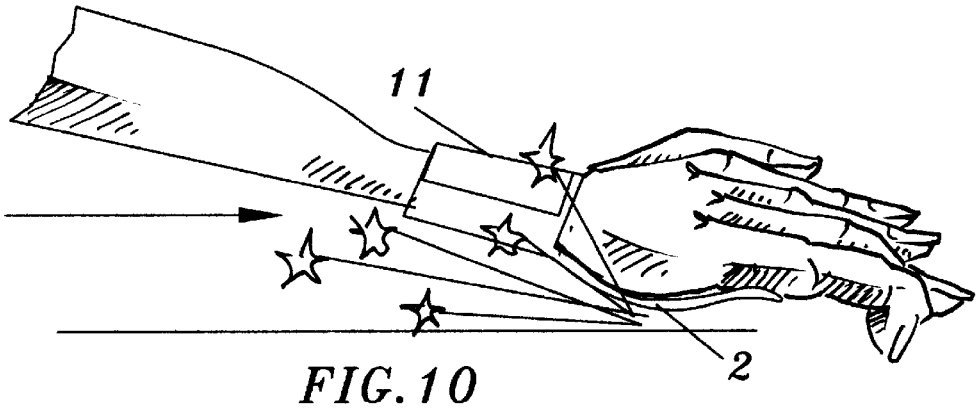
FIG. 10 illustrates a perspective view of a hand protector pad with flint pad rubbing an environmental surface.
Figure 11:
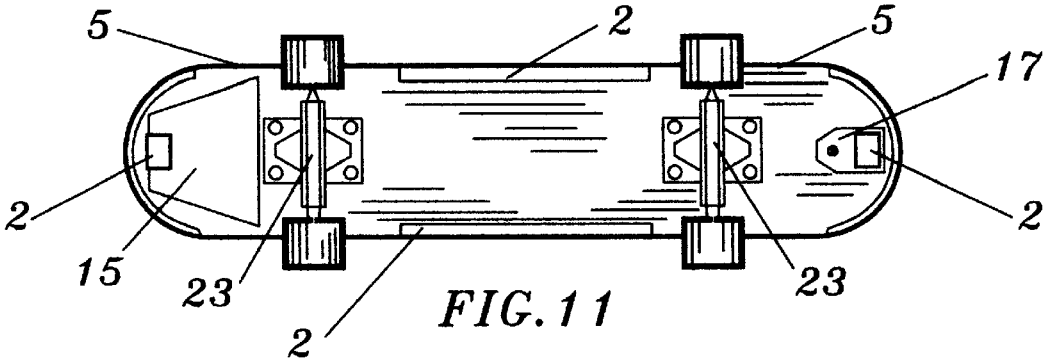
FIG. 11 illustrates a bottom plan view of a skateboard with alternate embodiments of the flint pads.
Figure 12:
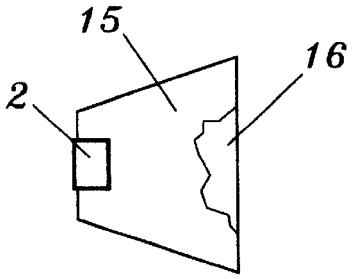
FIG. 12 illustrates a flint pad attached to an adhesive backed pad mount.
Figure 13:
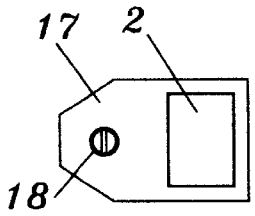
FIG. 13 illustrates a flint pad attached to a mount pad with fastener.

Referring to FIG. 6, a roller blade (7) has a flint pad (2) attached to the brake pad (8).

Referring to FIGS. 7 through 10, a flint pad (2) is attached to various protective devices used with recreational wheeled devices. An arm protector pad (9), knee protector pad (10) and hand protector pad (11) are illustrated. In addition a helmet (12) may be fitted with a flint pad (2).

Referring to FIGS. 11 through 15, a pad mount (15,17) may be used to attach to the skateboard (1). In this embodiment the flint pad (2) is attached to the pad mount (15,17) which has an adhesive surface (16) or fastener aperture (18) for attachment to the skateboard (1). The pad mount (15,17) may serve as a heat shield to protect the skateboard (1) surface from heat damage.

Figure 16:
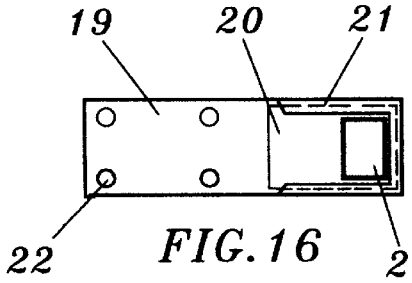
FIG. 16 illustrates a bottom plan view of a pad mount for attached to skateboard wheel structure.
Figure 14:
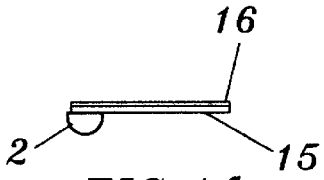
FIG. 14 illustrates a side elevation view of the flint pad and adhesive backed pad mount.
Figure 15:
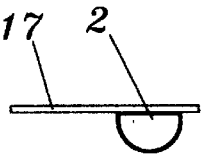
FIG. 15 illustrates a side elevation view of the mount pad with fastener.
Figure 17:
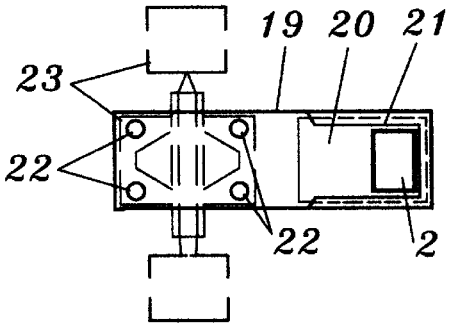
FIG. 17 illustrates a bottom plan view of a pad mount attachment to a the skateboard wheel mounts.

Referring to FIGS. 16 and 17, a pad mount (19) has wheel mount apertures (22) corresponding to a particular skateboard (1) wheel mount (23). This allows the pad mount (19) to be attached without drilling additional holes in the skateboard (1). The pad mount (19) has folded edges (21) on three sides to allow insertion and removal of slide mount (20) which has the flint pad (2) attached. This provides a simple means to replace used flint pads (2).

Figure 18:
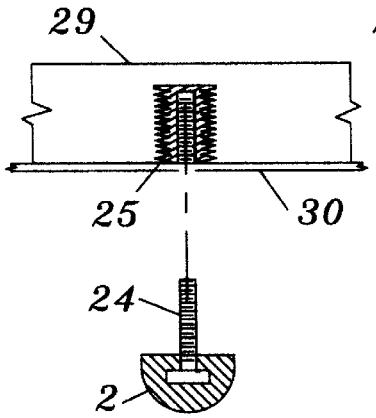
FIG. 18 illustrates a flint pad with imbedded screw to fasten to the skateboard.
Figure 19:
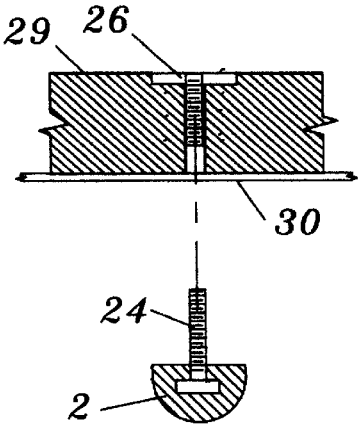
FIG. 19 illustrates a flint pad with imbedded screw to fasten to a through board insert in a skateboard.
Figure 20:
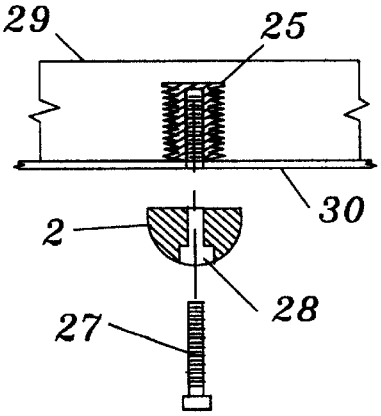
FIG. 20 illustrates a flint pad with aperture for using a screw to attach to the skateboard.

Referring to FIGS. 18 through 20, means to mount flint pads (2) directly to the skateboard (29) include using a fastener (24) such as a screw, bolt and the like. In such an attachment, a heat shield (30) to protect the skateboard (29) may be inserted between the skateboard (29) and the flint pad (2). In FIGS. 18 and 19 the fastener (24) is molded into the flint pad (2). The skateboard (29) has either a threaded insert (25) or a through board insert (26) to receive the fastener (24). FIG. 20 illustrates a flint pad (2) which has a fastener aperture (28) through which a fastener (27) may slide to engage threaded insert (25).

I claim:

1. A spark creating recreation device comprising a pad mount having a plurality of wheel mount apertures for attachment to a skateboard wheel mount and having a plurality of folded edges to slidably engage and retain a slide mount; and the slide mount having a flint pad attached thereto.

* * * * *